US005479900A

United States Patent [19]

Bodenhausen et al.

[11] Patent Number: 5,479,900

[45] Date of Patent: Jan. 2, 1996

[54] DEVICE FOR ATTACHING AND SECURING A VALVE

[75] Inventors: Eckhard Bodenhausen, Steinheim; Albrecht Baessler, Korntal-Müchingen, both of Germany

[73] Assignee: Robert Bosch GmbH, Stuttgart, Germany

[21] Appl. No.: 299,713

[22] Filed: Sep. 1, 1994

[30] Foreign Application Priority Data

Sep. 3, 1993 [DE] Germany ..... 43 29 774.9

[51] Int. Cl.[6] ..... F02M 61/14; F02M 51/06

[52] U.S. Cl. ..... 123/470

[58] Field of Search ..... 123/456, 468, 123/469, 470; 239/600

[56] References Cited

U.S. PATENT DOCUMENTS

| | | | |
|---|---|---|---|
| 4,527,745 | 7/1985 | Butterfield et al. | 239/600 |
| 4,562,964 | 1/1986 | Diamond | 239/600 |
| 4,660,774 | 4/1987 | Kwok et al. | 239/600 |
| 5,016,594 | 5/1991 | Hafner et al. | 123/470 |
| 5,070,844 | 12/1991 | Daly | 123/470 |
| 5,121,731 | 6/1992 | Jones | 123/470 |
| 5,140,963 | 8/1992 | Brackett et al. | 123/470 |
| 5,226,391 | 7/1993 | Gras et al. | 123/470 |
| 5,299,542 | 4/1994 | Hafner | 123/468 |
| 5,323,749 | 6/1994 | Gras et al. | 123/470 |

FOREIGN PATENT DOCUMENTS 0386444 9/1990 European Pat. Off. .

*Primary Examiner*—Thomas N. Moulis
*Attorney, Agent, or Firm*—Kenyon & Kenyon

[57] ABSTRACT

A device for attaching and securing a valve is particularly suited for fuel-injection systems of mixture-compressing internal combustion engines having externally supplied ignition. The device provides a twistable holding-down clamp which, together with an inner pressure element, prevents a fuel-injection valve from slipping and which, together with an outer fixing ring as a part of a bayonet catch, whose corresponding bayonet locking bars are constructed on the fuel distributor, ensures a simple and reliable attachment to the fuel distributor. The holding-down clamp is sealed by the sealing cap, which is set down on the holding-down clamp and through which the connecting cables also run. The fuel-injection valve does not have any functional elements for attaching in the valve-mount opening of the fuel distributor.

18 Claims, 4 Drawing Sheets

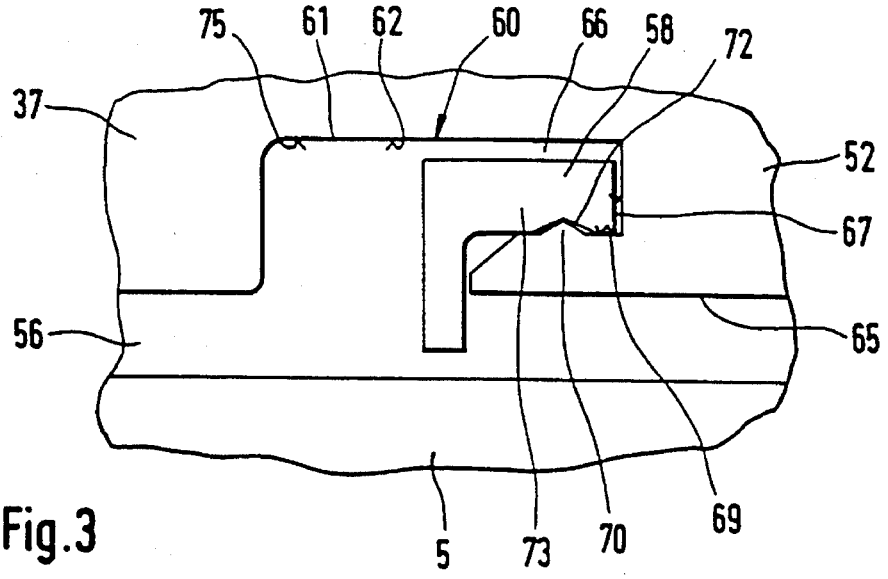
Fig.3
Fig.4
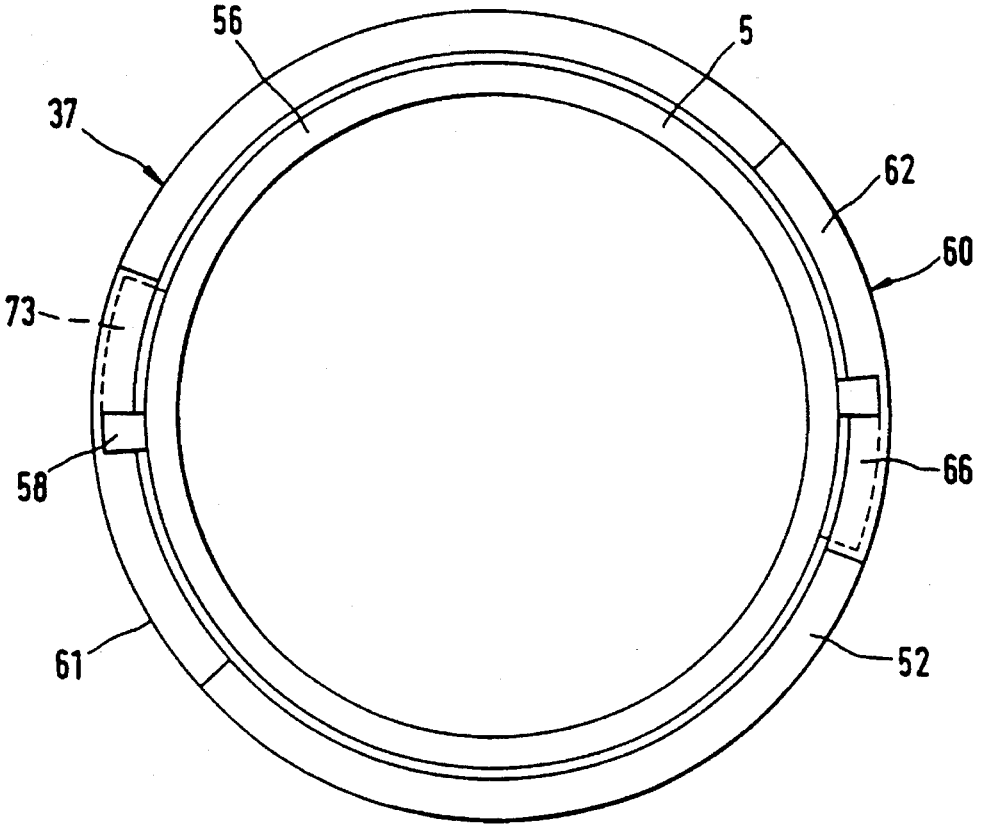

DEVICE FOR ATTACHING AND SECURING A VALVE

FIELD OF THE INVENTION

The present invention relates to a device for attaching and securing a valve. More particularly, the present invention relates to a device for attaching and securing a fuel injection valve in an internal combustion engine.

BACKGROUND OF THE INVENTION

An electrically operable fuel-injection valve, which is able to be secured with a bayonet catch to a fuel distributor by turning the valve around its longitudinal valve axis, has been described in European Patent Application No. EP O 386 444 B1. The first electrical contact elements of the fuel-injection valve, which project out of the valve housing, parallel to the longitudinal valve axis, are electrically contacted by two electrical contact elements, which are arranged on a contacting connector that is capable of being placed on the fuel distributor in the direction of the longitudinal valve axis.

The contacting connector, which is capable of being placed on the fuel distributor, is provided with threaded bushings or spacer sleeves, to guarantee the mounting attachment on the fuel distributor. The bayonet catch provided to secure the fuel-injection valve is constructed with its bayonet locking bars situated directly on the fuel-injection valve and is in contact with recesses of the bayonet lock on the fuel distributor. Consequently, only fuel-injection valves provided with elements of the bayonet catch are able to be installed in the fuel distributor. A plug-connector cap to be placed on the fuel distributor must be secured with connecting elements, such as screws.

SUMMARY OF THE INVENTION

An advantage of the device according to the present invention for attaching and securing a valve is that the valve, designed for example as a fuel-injection valve, is able to be mounted in a simple, compact, easy and secure manner in a fuel distributor and is able to be optionally secured to the fuel distributor. The simple and compact type of construction of the device results in a simple and fast assembly when the fuel-injection valve is secured. The catch for securing the fuel-injection valve is not situated directly on the fuel-injection valve, but rather on the device according to the present invention, so that a universal application of various types of valves is possible.

The device according to the present invention is particularly advantageous in so far as it can be used both for a single fuel-injection valve, given a central injection system, as well as for a plurality of fuel-injection valves arranged, for example, in series. This flexibility is also advantageous when the intention is to vary how the flexible connecting cables run out of the fuel-injection valve, for example, directly to a plug connector or to an adjacent fuel-injection valve.

To guarantee a secure and reliable attachment of the fuel-injection valve to a fuel distributor being used as a valve-mounting device, it is advantageous when at least two bayonet locking bars are provided on this fuel distributor, which are used to form a bayonet catch.

BRIEF DESCRIPTION OF THE DRAWINGS

FIG. 3 shows a bayonet catch used to secure a valve in a locked condition according to a preferred embodiment of the present invention.

FIG. 4 shows another view of a bayonet catch used to secure a valve in a locked condition according to a preferred embodiment of the present invention.

DETAILED DESCRIPTION

Figure 1:
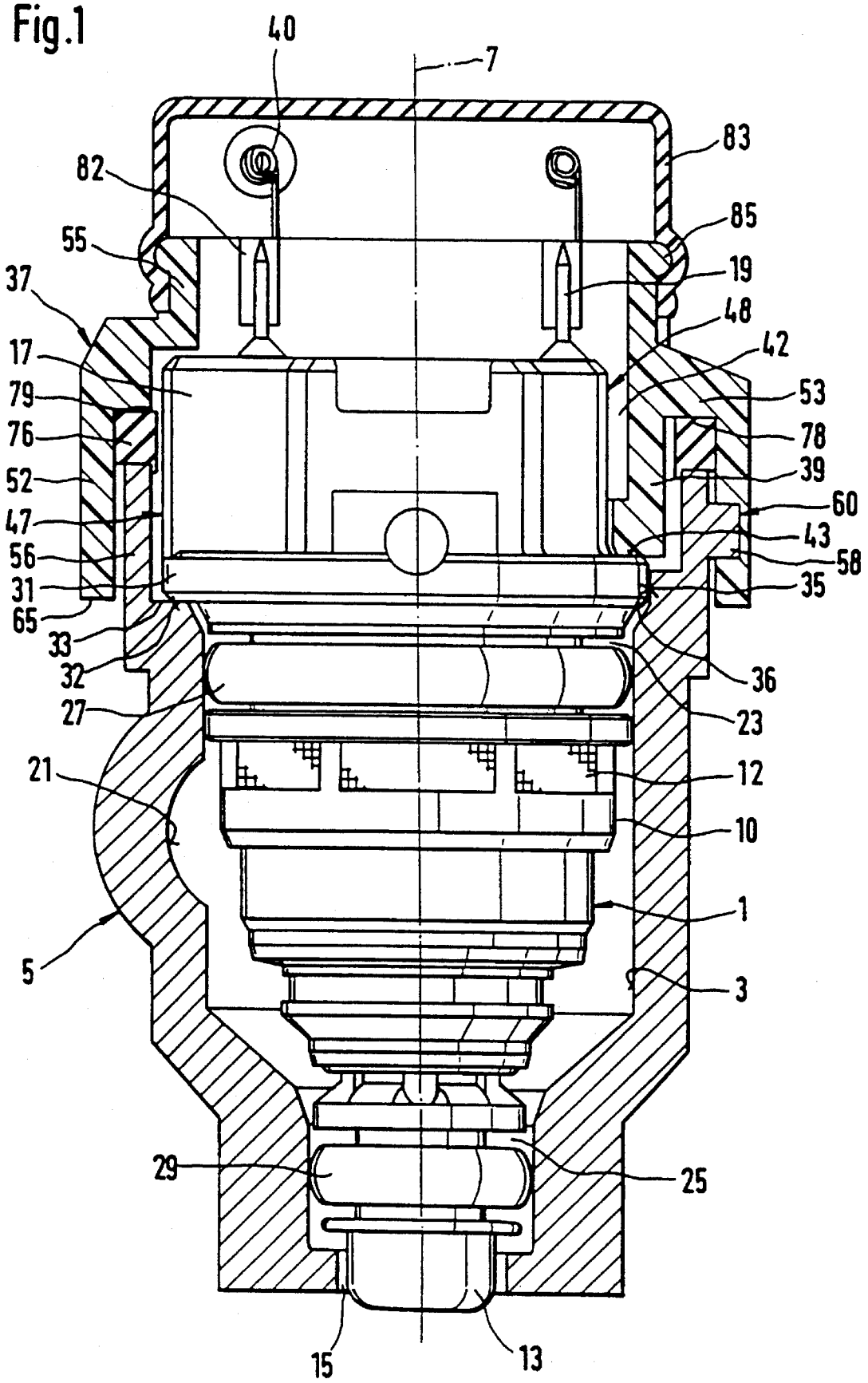
FIG. 1 shows a first preferred embodiment of a device according to the present invention for attaching and securing a valve.

FIGS. 1 through 5 depict, by way of example, devices according to the present invention for attaching and securing a valve in the form of an electrically, for example electromagnetically, actuated fuel-injection valve 1 for fuel-injection systems of mixture-compressing internal combustion engines having externally supplied ignition.

The fuel-injection valve 1 is inserted into a valve-mount opening 3 of a fuel distributor 5 serving as a valve-mount device, the valve-mount opening 3 having, for example, a circular cross-section and being stepped right through, and is at least partially surrounded by the inner wall of the valve-mount opening 3 in the direction of a longitudinal valve axis 7. The fuel distributor 5 has, for example, an elongated shape running perpendicularly to the drawing plane, and has a plurality of valve-mount openings 3, which are open on both sides during assembly of the fuel-injection valves 1. It is used to supply fuel, for example, to several fuel-injection valves 1 and is arranged, for example, on an induction pipe, not shown, of an internal-combustion engine.

On the periphery of its valve housing 10, the fuel-injection valve 1 has fuel-supply openings, which are covered by a circumferential fuel filter 12, and through which the fuel can attain the inside of the fuel-injection valve 1. The fuel filter 12 and the fuel-supply openings following radially behind it in the direction of the longitudinal valve axis 7 are situated in the middle area of the axial extent of the fuel-injection valve 1, which is why one can speak of a so-called side-feed injection valve.

To spray off the fuel, an injection member 13 at one end of the fuel-injection valve 1 is used, which delivers the fuel into an opening of the induction pipe situated downstream from an orifice 15 arranged in the fuel distributor 5. Facing away from the injection member 13 and at its other end serving as a connecting end 17, the fuel-injection valve 1 has, for example, two electrical contact elements 19, which extend in the axial direction parallel to the longitudinal valve axis 7, and are used to electrically contact the electrically actuated fuel-injection valve 1.

A longitudinally running fuel-supply channel 21, which is used to supply fuel to the fuel-injection valves 1 and, for example, is in tangential contact with the valve-mount openings 3, is formed in the fuel distributor 5. An upper circumferential groove 23 is formed on the periphery of the fuel-injection valve 1, facing the connecting end 17 and upstream from the fuel filter 12, and a lower circumferential groove 25 is formed in the area of the injection member 13, downstream from the fuel filter 12 and the fuel-supply openings. Arranged in the upper circumferential groove 23 is an upper sealing ring 27, and arranged in the lower circumferential groove 25 is a lower sealing ring 29, which are used as sealing means between the periphery of the fuel-injection valve 1 and the inner wall of the valve-mount opening 3.

A retaining flange 31, which extends outwardly in the radial direction, is designed on the valve housing 10, contiguously, for example, to the connecting end 17 of the fuel-injection valve 1 running, for exanple, asymmetrically to the longitudinal valve axis 7 in the direction facing the injection member 13. The fuel-injection valve 1 abuts with one contact surface 32 of the retaining flange 31 facing the injection member 13 against a retention offset 33 of the stepped valve-mount opening 3. On the periphery of the retaining flange 31, an area is provided, for example, with a flattened section 35, which extends at the most, for example, over 45°, so that possibly, the retaining flange 31 is not able to rest on the retention offset 33 in this small area. The flattening 35 on the retaining flange 31 is used, together with a flattened mating component 36 formed on the fuel distributor 5, to ensure a clearly defined fitting position for the fuel-injection valve 1, so that the fuel-injection valve 1 can no longer twist in the fuel distributor 5.

The first preferred embodiment shown in FIGS. 1 through 4 of the device according to the present invention for attaching and securing a fuel-injection valve 1 has a twistable holding-down clamp 37, which is manufactured of a plastic, for example, and which, after the fuel-injection valve 1 is inserted into the valve-mount opening 3 of the fuel distributor 5, acts with an inner pressure element 39 upon the retaining flange 31 of the fuel-injection valve 1 and ensures that the fuel-injection valve 1 is held down. Thus, clamp 37 simply and effectively prevents the fuel-injection valve 1 from slipping as the result of vibrations caused during operation of the internal combustion engine.

Figure 2:
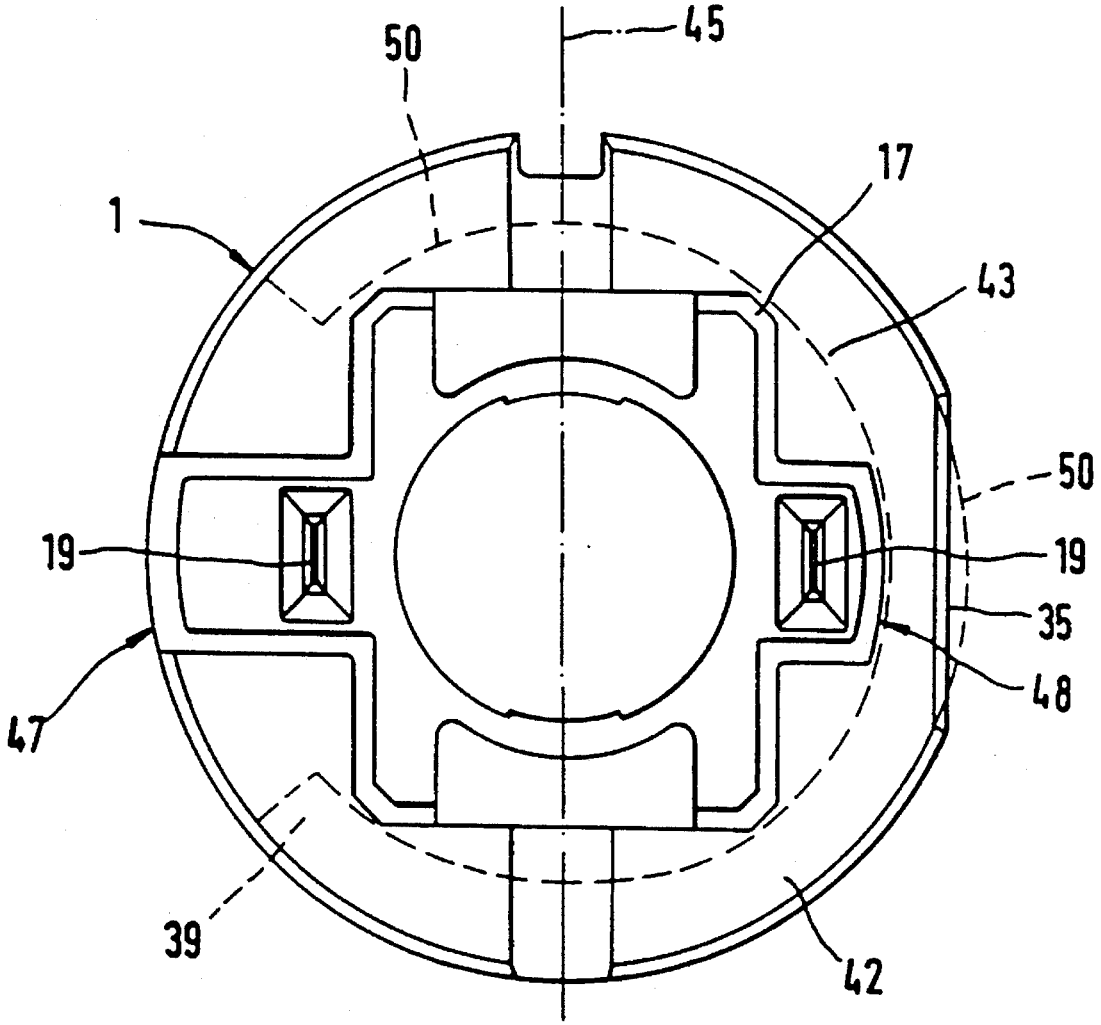
FIG. 2 shows a top view of the connecting end of a valve according to the present invention.

FIG. 2 shows a top view of the connecting end 17 of the fuel-injection valve 1. The connecting end 17 has, for example, two electrically conductive contact elements 19, which are able to be electroconductively connected to connecting cables 40. An incompletely circumferential annular area 42 is formed at the connecting end 17 of the fuel-injection valve 1 to accommodate the inner pressure element 39 of the holding-down clamp 37. In the case of fuel-injection valves having symmetrical connecting ends 17, the annular area 42 can be completely circumferential, so that the pressure element 39 of the holding-down clamp 37 can be formed over 360°.

With a set-down surface 43, the exposed annular area 42 provided to accommodate the pressure element 39 terminates the retaining flange 31, and consequently delimits the retaining flange 31 exactly opposite the contact surface 32. The connecting end 17 is arranged asymmetrically, for example, in relation to a connecting line 45, which separates the electrical contact elements 19. Thus, two projections 47 and 48 result, for example, which surround the contact elements 19 and extend perpendicularly to the connecting line 45. The asymmetrical formation of the connecting end 17 of the fuel-injection valve 1 provides a protection against polarity reversal for the fuel-injection valve 1. Dotted lines 50 indicate the tolerances within which the pressure element 39 of the holding-down clamp 37 contacts the set-down surface 43 of the retaining flange 31 outside of the projection 47, or rather projects out over it in the flattened area 35.

Besides the inner pressure element 39 directed toward the retaining flange 31, the holding-down clamp 37 is comprised of an external fixing ring 52 running parallel to the inner pressure element 39. Fixing ring 52 is completely circumferential and wraps around one end 56 of the fuel distributor 5, of a connecting member 53 between the inner pressure element 39 and the external fixing ring 52, and of an end region 55 formed in the area of the axial extent of the electrical contact elements 19.

In addition to its function of holding down the fuel-injection valve 1, the holding-down clamp 37 also has the task of ensuring a clearly defined, easily manipulated, and re-releasable mounting attachment of the fuel-injection valve 1 in the fuel distributor 5. For that reason, the holding-down clamp 37 and the end 56 of the fuel distributor 5 situated opposite the orifice 15 are equipped with elements, which render possible a bayonet joint.

Provided on the periphery of the end 56 of the fuel distributor 5 are, for example, two locking parts, which extend outwardly in the radial direction beyond the periphery of the end 56 and serve as bayonet locking bars 58, which, for example, mutually oppose one another, extend in the circumferential direction only over one portion of the end 56 of the fuel distributor 5, and have an L-shaped contour. The bayonet locking bars 58 are used to secure the fuel-injection valve 1 by means of a bayonet catch 60, shown in detail in FIGS. 3 and 4, to the fuel distributor 5, in that the fuel-injection valve 1 is inserted into the valve-mount opening 3 of the fuel distributor 5, the holding-down clamp 37 is subsequently set down on the fuel-injection valve 1, and the fuel-injection valve 1 is secured by turning the holding-down clamp 37 around the longitudinal valve axis 7.

Facing away from the injection member 13 of the fuel-injection valve 1, a bayonet lock 61 is constructed in the fixing ring 52 of the holding-down clamp 37 to accommodate, for example, two bayonet locking bars 58. The bayonet locking bars 58 and the bayonet lock 61 make up corresponding locking parts of the bayonet catch 60. The bayonet lock 61 has, for example, two mutually opposing L-shaped recesses 62, which are provided in the fixing ring 52 to introduce the bayonet locking bars 58 of the fuel distributor 5, which extend starting from a bottom edge 65 of the fixing ring 52 into the fixing ring 52 in the direction of the contact elements 19.

Subsequent to the introduction of the bayonet locking bars 58 of the fuel distributor 5 into the bayonet lock 61, overlapping sections 66, which wrap around the bayonet locking bars 58 in the locked state, adjoin the recesses 62 in the circumferential direction. Limit stops 67 for the bayonet locking bars 58 are provided at the ends of the overlapping sections 66. The limit stops 67 establish the rotation position of the holding-down clamp 37 and, thus, the area where the pressure element 39 contacts the fuel-injection valve 1.

The first bayonet locking bar 58 is arranged in the circumferential area of the pressure element 39, and the second bayonet locking bar 58 is arranged, for example, outside of the pressure element 39. The overlapping sections 66 of the bayonet lock 61 are designed so that, at any one time, for example, one prism-shaped or conical detent 70 projects out, on a bottom 69 of the overlapping sections 66, in the direction of the end area 55 of the holding-down clamp 37. Correspondingly, a depression 72 is provided in the bayonet locking bars 58 to accommodate the detent 70 of the fixing ring 52, to ensure a positive latching and, consequently, to provide for the definitive locking of the holding-down clamp 37 on the fuel distributor 5.

To guarantee that the bayonet locking bars 58 are inserted into the overlapping sections 66 over the detents 70, the recesses 62 of the bayonet lock 61 are designed to have larger dimensions in the axial direction of the longitudinal valve axis 7 than the bayonet tongues 73 extending in the circumferential direction and forming a lateral side of the L-shaped bayonet locking bars 58. A problem-free insertion into the overlapping sections 66 is rendered possible in that during the assembly of the holding-down clamp 37, this clamp is pressed with its recesses 62 over the bayonet locking bars 58 so as to allow the bayonet tongues 73 to reach up to a cover 75 opposite the bottom 69 in the recesses 62, the engagement with the detent 70 first taking place when the bayonet tongues 73 are lowered from the cover 75 to the bottom 69.

A flexible insertion of the bayonet locking bars 58 are inserted into the bayonet lock 61 is achieved in that a circumferential gasket 76 is provided in the holding-down clamp 37. The gasket 76 is cemented into place, for example, in an annular depression 78 formed between the fixing ring 52 and the pressure element 39, or rather outside of the pressure element 39 on a recess 79 between the fixing ring 52 and the connecting piece 53. Another variant for introducing the gasket 76 involves placing the gasket 76 on the end 56 of the fuel distributor 5 and, for example, cementing it on, so that the holding-down clamp 37 can then be set down without a gasket. The gasket 76 ensures that the holding-down clamp 37 is sealed and renders possible the functioning of the bayonet catch 60 by pressing on the gasket 76.

The electrical contacting takes place after the fuel-injection valve 1 is affixed by means of the holding-down clamp 37. For this purpose, a preassembled, flexible cable harness 80 is used, which has connecting cables 40 with cable lugs 82. The already known cable lugs 82 are installed thereby on the electrical contact elements 19 of the fuel-injection valve 1, so as to be situated later inside a sealing cap 83, while the connecting cables 40 exit the sealing cap 83 to the outside. In the initial assembly operation, the cable lugs 82 are set down on the contact elements 19 of the fuel-injection valve 1, through which means an electrically conductive connection is established from the connecting cables 40 to the fuel-injection valve 1.

After the contacting operation, the round sealing cap 83, formed of, for example, rubber, is set down on the end region 55 of the holding-down clamp 37 and seals off the same. The sealing action is reliably guaranteed by the radial prestressing of the sealing cap 83, a secure seating of the sealing cap 83 being reinforced by a circumferential retaining lip 85 formed on the end region 55 of the holding-down clamp 37, the sealing cap 83 being slid over this retaining lip 85. The connecting cables 40 push through the sealing cap 83 in a sleeve 86, shown in FIG. 5, which serves as a cable guide and is manufactured, for example, directly with and designed together in one piece with the sealing cap 83, and which seals off the connecting cables 40 and protects them from bending. The connecting cables 40 can lead in the cable harness 80 to a next fuel-injection valve or, for example, in the case of central injection, directly to a plug connector, not shown.

Figure 5:
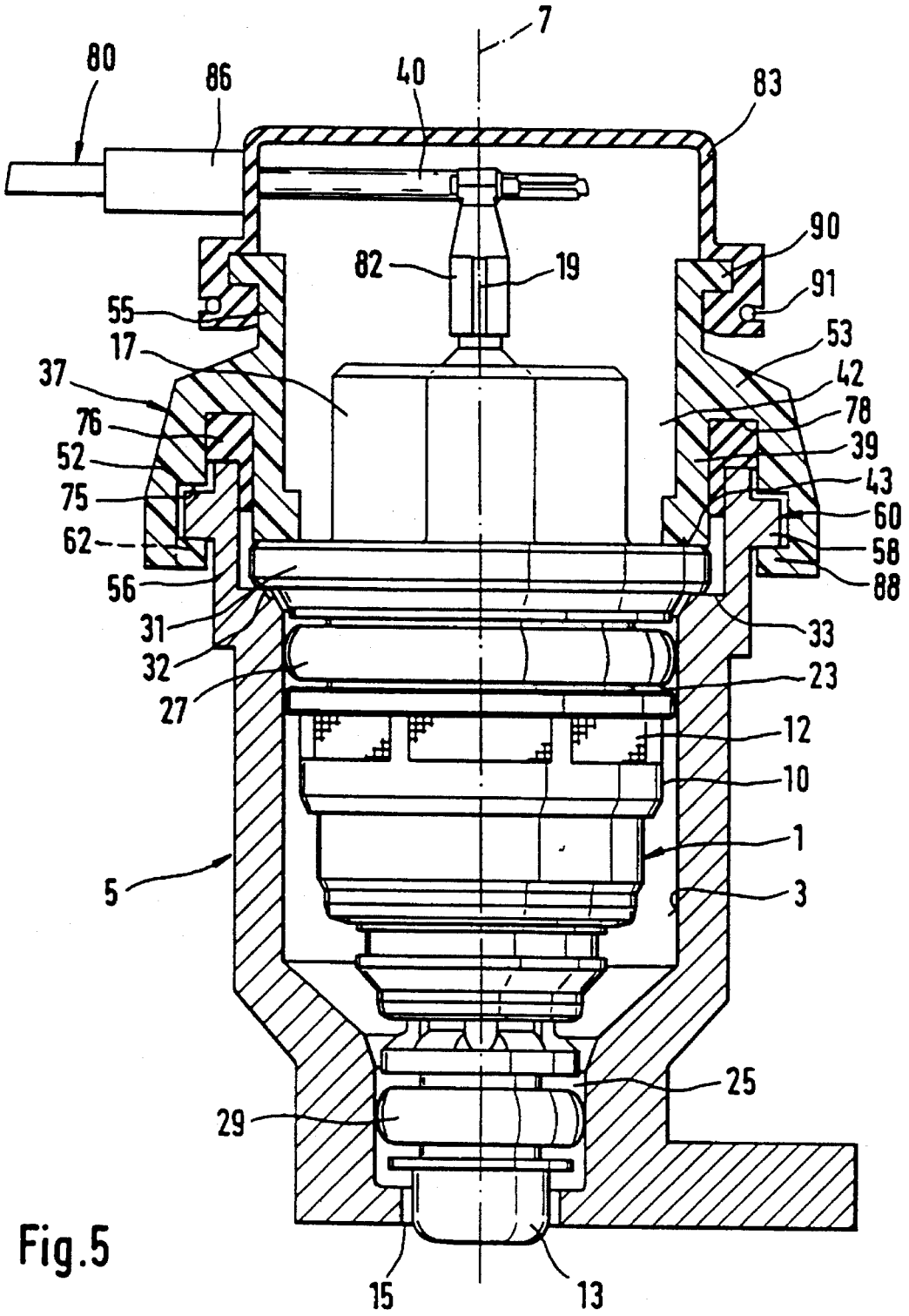
FIG. 5 shows a second preferred embodiment of a device for attaching and securing a valve.

A second preferred embodiment of a device according to the present invention for attaching and securing a fuel-injection valve 1 is shown in FIG. 5, in which parts remaining the same or having the same functioning as in first preferred embodiment have the same reference numerals. Compared to the preferred embodiment shown in FIG. 1, the fuel-injection valve 1 is turned in this case by 90° around the longitudinal valve axis 7. The exemplified embodiments differs from the first exemplified embodiment only in the areas of the bayonet catch 60 and of the sealing cap 83. The bayonet catch 60 is designed, for example, to have two or four bayonet locking bars 58 developed as individual segments project radially out of the end 56 of the fuel distributor 5. These bayonet locking bars 58 are designed with an elongated shape in the circumferential direction. The mating component for realizing the bayonet catch 60 is again comprised of the fixing ring 52 of the holding-down clamp 37. Radial lugs 88 are formed on the fixing ring 52 and extend so as to reach under the bayonet locking bars 58 after assembly of the holding-down clamp 37.

To insert the bayonet locking bars 58 into the fixing ring 52, at least exactly as many recesses 62 are provided as there are bayonet locking bars 58, thus, for example, two or four. After the bayonet locking bars 58 dip into the recesses 62, approximately up to the cover 75, the holding-down clamp 37 can be twisted with its fixing ring 52. The radial lugs 88 of the fixing ring 52 extend under the bayonet locking bars 58 up to a limit stop, for example. The gasket 76 being tensioned when the bayonet catch 60 is being closed can now be somewhat relieved of stress again, thereby guaranteeing that the radial lugs 88 fit tightly on the bayonet locking bars 58.

Provided, for example, on the holding-down clamp 37 is a circumferential collar 90, across which the sealing cap 83 is tensioned. The sealing cap 83 thereby has a stepped design and, at its end facing the fuel-injection valve 1, has, for example, an inserted wire ring 91, through which means dropping of the sealing cap 83 is entirely avoided.

The device according to the present invention for attaching and securing a valve, in particular a fuel-injection valve 1, together with the holding-down clamp 37 pressing on the fuel-injection valve 1 and the bayonet catch 60 between the holding-down clamp 37 and the fuel distributor 5, represents a simple, very compact, and reliable securing alternative. The holding-down clamp 37 and the sealing cap 83 can be used universally for various types of valves, since no locking technique is provided on the fuel-injection valve 1 itself. The locking technique according to the invention can be used for a central injection system, as well as for a plurality of injection valves arranged, for example, in series, since each individual fuel-injection valve 1 can be connected separately and the connecting cables 40 are flexible.

What is claimed is:

1. A device for attaching and securing a valve, comprising:

a first valve mount member having an opening for receiving the valve;

a second member including a rotatable holding-down clamp for releasably engaging the first valve mount member to secure the valve in an inserted position; and means for releasably engaging the first valve mount member and the second member, wherein the means includes a bayonet locking bar provided on the first valve mount member and a bayonet lock provided in a corresponding relationship on the second member, the bayonet locking bar releasably interlocking the bayonet lock to form a bayonet catch.

2. The device according to claim 1, wherein the valve includes an electromagnetically actuated fuel injection valve for an internal combustion engine.

3. The device according to claim 1, wherein the second member further includes:

an inner pressure element for releasably abutting an upper end of the valve to prevent the valve from slipping;

an external fixing ring including the bayonet lock;

a connecting member disposed between the inner pressure element and the external fixing ring; and an end region located in a direction opposite a lower end of the valve.

4. The device according to claim 1, wherein the bayonet locking bar includes at least two bayonet locking bars provided on a periphery of the first valve mount member and the bayonet lock includes at least two bayonet locks, each of the at least two bayonet locks being arranged in a corresponding relationship with a respective one of the at least two bayonet locking bars.

5. The device according to claim 1, wherein the bayonet locking bar is L-shaped and the bayonet lock has an L-shaped recess for releasably interlocking the bayonet locking bar with the bayonet lock.

6. The device according to claim 3, wherein the external fixing ring and the end region have circumferential peripheries.

7. The device according to claim 3, wherein the inner pressure element and the external fixing ring define an annular depression, and further comprising a circumferential gasket arranged in the annular depression.

8. The device according to claim 3, further comprising a sealing cap sealably connected to the end region of the second member, the sealing cap having an inner wall.

9. The device according to claim 8, further comprising a retaining lip formed on the end region of the second member, wherein the sealing cap is partially slid over the retaining lip and onto the end region of the second member.

10. The device according to claim 8, further comprising a sleeve extending through the sealing cap inner wall to serve as a cable guide for cables connected to the valve.

11. The device according to claim 4, wherein the at least two bayonet locking bars are L-shaped and the at least two bayonet locks have L-shaped recesses for releasably interlocking the at least two bayonet locking bars with the at least two bayonet locks.

12. The device according to claim 1, wherein the second member further includes:

an inner pressure element for releasably abutting an upper end of the valve to prevent the valve from slipping;

an external fixing ring;

a connecting member disposed between the inner pressure element and the external fixing ring; and an end region located in a direction opposite a lower end of the valve.

13. The device according to claim 12, wherein the external fixing ring and the end region have circumferential peripheries.

14. The device according to claim 12, wherein the inner pressure element and the external fixing ring define an annular depression, and further comprising a circumferential gasket arranged in the annular depression.

15. The device according to claim 12, further comprising a sealing cap sealably connected to the end region of the second member, the sealing cap having an inner wall.

16. The device according to claim 15, further comprising a retaining lip formed on the end region of the second member, wherein the sealing cap is partially slid over the retaining lip and onto the end region of the second member.

17. The device according to claim 15, further comprising a sleeve extending through the sealing cap inner wall to serve as a cable guide for cables connected to the valve.

18. The device according to claim 1, wherein the second member is composed of a plastic.

* * * * *